US005633701A

United States Patent [19]

Yoshida

[11] Patent Number: 5,633,701

[45] Date of Patent: May 27, 1997

[54] CONDUCTIVE BRUSH CHARGING DEVICE

[75] Inventor: Sadaaki Yoshida, Kawasaki, Japan

[73] Assignee: Fujitsu Limited, Kawasaki, Japan

[21] Appl. No.: 630,602

[22] Filed: Apr. 10, 1996

[30] Foreign Application Priority Data

Jul. 27, 1995 [JP] Japan ..... 7-191976

[51] Int. Cl.[6] ..... G03G 15/02

[52] U.S. Cl. ..... 399/175

[58] Field of Search ..... 355/219, 296, 355/297, 301, 302, 303; 361/225

[56] References Cited

FOREIGN PATENT DOCUMENTS 63-221366 9/1988 Japan .
3-288184 12/1991 Japan .
4-289878 10/1992 Japan .
4-366865 12/1992 Japan .

*Primary Examiner*—Joan H. Pendegrass
*Assistant Examiner*—Quana Grainger
*Attorney, Agent, or Firm*—Armstrong, Westerman, Hattori, McLeland, & Naughton

[57] ABSTRACT

Disclosed herein is a conductive brush charging device for charging the surface of an image forming member. The conductive brush charging device includes a conductive brush located so as to rotate in contact with the image forming member, and a developer removing member formed of a porous material and located so as to be kept in surface contact with the conductive brush over the width thereof. When the conductive brush is rotated, the porous developer removing member rubs against the brush along its bristles to thereby remove a developer deposited to the brush. Since the developer removing member is formed of the porous material, the developer removed is retained in numerous pores of the porous developer removing member, thus achieving a long-term cleaning function.

7 Claims, 10 Drawing Sheets

CONDUCTIVE BRUSH CHARGING DEVICE

BACKGROUND OF THE INVENTION

1. Field of the Invention

The present invention relates to a conductive brush charging device having a rotating conductive brush for charging to a given potential a photosensitive drum in an image forming device such as an electrophotographic printer.

2. Description Of the Related Art

Recent development of office automation has brought about a wide use of an electrophotographic image forming device such as a laser beam printer in computer output terminal equipment, facsimile equipment, copiers, etc. In such an image forming device, a photosensitive drum is charged to a given potential by a charger, and is next exposed to light according to image information to form an electrostatic latent image on the photosensitive drum. Thereafter, the electrostatic latent image on the photosensitive drum is developed with a toner to form a toner image, which is in turn transferred to a sheet of recording paper. The toner image transferred to the recording paper is next fixed to obtain a hard copy. After the transfer step, the photosensitive drum is de-electrified by an eraser, and the residual toner left on the surface of the photosensitive drum is scraped from the surface of the photosensitive drum by a cleaner, thus completing one cycle of print operation.

As the charger for charging the photosensitive drum surface to a given potential, a corona charger, a conductive roller charger, or a conductive brush charger is widely used. Of these chargers, the conductive brush charger has recently been noticed owing to its low cost, and the usability thereof is increasing. In an electrophotographic printer employing such a brush charger, a small amount of fine toner particles or fine additive particles yet remains on the photosensitive drum even after cleaning the residual toner from the photosensitive drum by using the cleaner.

The toner or additive left on the photosensitive drum after cleaning sticks to a rotating brush of the brush charger, causing a deterioration in charging characteristics of the brush charger to the photosensitive drum. As a result, there occurs a stain called "fog" in the background area of each printed sheet with an increase in number of printed sheets, thus reducing a print quality. Further, since the service life of the rotating brush of the conductive brush charger is relatively short, it is desired to achieve a method of effectively removing the toner or additive deposited to the rotating brush without reducing the service life of the rotating brush.

FIG. 9 shows a conductive brush charger 4 in the prior art. In the configuration shown in FIG. 9, a given voltage is applied to a rotating conductive brush 4*a* of the brush charger 4, so that the surface of a photosensitive drum 2 is charged to a given potential by sliding contact between the conductive brush 4*a* and the photosensitive drum 2. The photosensitive drum 2 is next exposed to light according to image information by an optical unit (not shown) to form an electrostatic latent image on the photosensitive drum 2. The electrostatic latent image is next developed with a toner to form a toner image, which is in turn transferred to a sheet of recording paper. The residual toner left on the photosensitive drum 2 after transferring the toner image is cleaned from the photosensitive drum 2 by a cleaner (not shown), thus completing one cycle of print operation.

In this manner, the residual toner on the photosensitive drum 2 is cleaned from the photosensitive drum 2 by the cleaner; however, a fine toner 3 in particular cannot be completely cleaned off by the cleaner and remains on the photosensitive drum 2 in some cases. This residual toner 3 on the photosensitive drum 2 sticks to the rotating conductive brush 4*a* in charging the photosensitive drum 2 with the brush charger 4. Although the amount of the residual toner 3 sticking to the conductive brush 4*a* is small in actual, the charging characteristics of the brush charger 4 to the photosensitive drum 2 are largely affected by the deposition of the residual toner 3. As a result, the charging characteristics of the brush charger 4 to the photosensitive drum 2 are reduced to cause the occurrence of fog in the background area of a printed sheet. An increase in number of cycles of print operation causes cumulation of the deposited toner on the conductive brush 4*a*, resulting in an increase in the fog occurring in the background area.

FIG. 10 shows another conductive brush charger 4' in the prior art intended to solve the above problem. The conductive brush charger 4' has a toner removing plate 5 kept in contact with a conductive brush 4*a* to scrape off a toner 3 deposited to the conductive brush 4*a*. The toner 3 removed by the toner removing plate 5 is stored into a toner receptacle 6. According to this configuration, the toner deposited to the conductive brush 4*a* can be removed by the toner removing plate 5, so that the charging characteristics of the conductive brush charger 4' to the photosensitive drum 2 can be improved to some extent. However, since the toner removing plate 5 is merely penetrated into the conductive brush 4*a*, the efficiency of removing the toner deposited to the conductive brush 4*a* is low. Accordingly, the charging characteristics of the brush charger 4' to the photosensitive drum 2 are reduced with the elapse of long time.

Other known conductive brush chargers will now be described.

Japanese Patent Laid-open No. Hei 3-288184 discloses a technique of rotating a developer removing member with vibration about the center of rotation of a rotary brush. However, the developer removing member partially removes a developer deposited to the tip of the rotary brush, and cannot completely remove the developer deposited to the brush. Japanese Patent Laid-open No. Hei 4-289878 discloses a conductive brush charger having a round rod for removing a toner deposited to a conductive brush. However, the toner once removed is possibly deposited again to the conductive brush, so it is difficult to efficiently remove the toner deposited to the conductive brush.

While other techniques are disclosed in Japanese Patent Laid-open No. Hei 4-366865 and No. Sho 63-221366, it is difficult to completely remove a toner deposited to a conductive brush according to these techniques, and there remains the problem that the charging characteristics of the brush charger to the photosensitive drum are reduced with the elapse of time.

As mentioned above, in the conventional conductive brush chargers, the toner deposited to the conductive brush cannot be completely removed. As a result, the repetition of print cycles over a long period of time causes cumulation of the toner deposited to the conductive brush, reducing the charging characteristics of the conductive brush charger to result in the occurrence of fog in the background area of each printed sheet.

SUMMARY OF THE INVENTION

It is therefore an object of the present invention to provide a conductive brush charging device which can efficiently remove a toner deposited to a conductive brush kept in contact with an image forming member, thereby preventing a deterioration in charging characteristics of the conductive brush to the image forming member.

In accordance with an aspect of the present invention, there is provided a conductive brush charging device for charging the surface of an image forming member, comprising a conductive brush located so as to rotate in contact with the image forming member; a voltage applying means for applying a given voltage to the conductive brush; and a developer removing member formed of a porous material and located so as to be kept in surface contact with the conductive brush over an entire width thereof.

The developer removing member comprises a plate member formed of a foamed material. Alternatively, the developer removing member comprises a roller formed of a foamed material. Further, the developer removing member may be formed of a conductive material, and a voltage higher than the given voltage applied to the conductive brush may be applied to the developer removing member in this case.

With the above configuration, the developer removing member formed of a porous material is kept in surface contact with the conductive brush over the entire width thereof. Accordingly, when the conductive brush is rotated, the porous developer removing member rubs against the conductive brush along its bristles, thereby efficiently removing the developer deposited to the brush.

Further, since the developer removing member is formed of a porous material, the developer removed is retained in numerous pores of the porous developer removing member, thereby achieving a long-term cleaning function. As a result, the charging characteristics of the conductive brush to the image forming member can be maintained at a satisfactory level over a long period of time to thereby prevent the occurrence of fog in the background area of a printed sheet and accordingly improve a print quality.

Further, since the developer removing member is formed of a porous material, the developer removed is retained in the pores of the porous developer removing member as mentioned above, Accordingly, unlike the prior art, it is unnecessary to provide a receptacle for receiving the developer scraped from the conductive brush. In the case that the developer removing member is conductive and a given voltage is applied to the conductive developer removing member, the developer can be removed not only by sliding contact between the developer removing member and the conductive brush, but also by electrical attraction. As a result, the efficiency of removing the developer can be further improved in this case.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
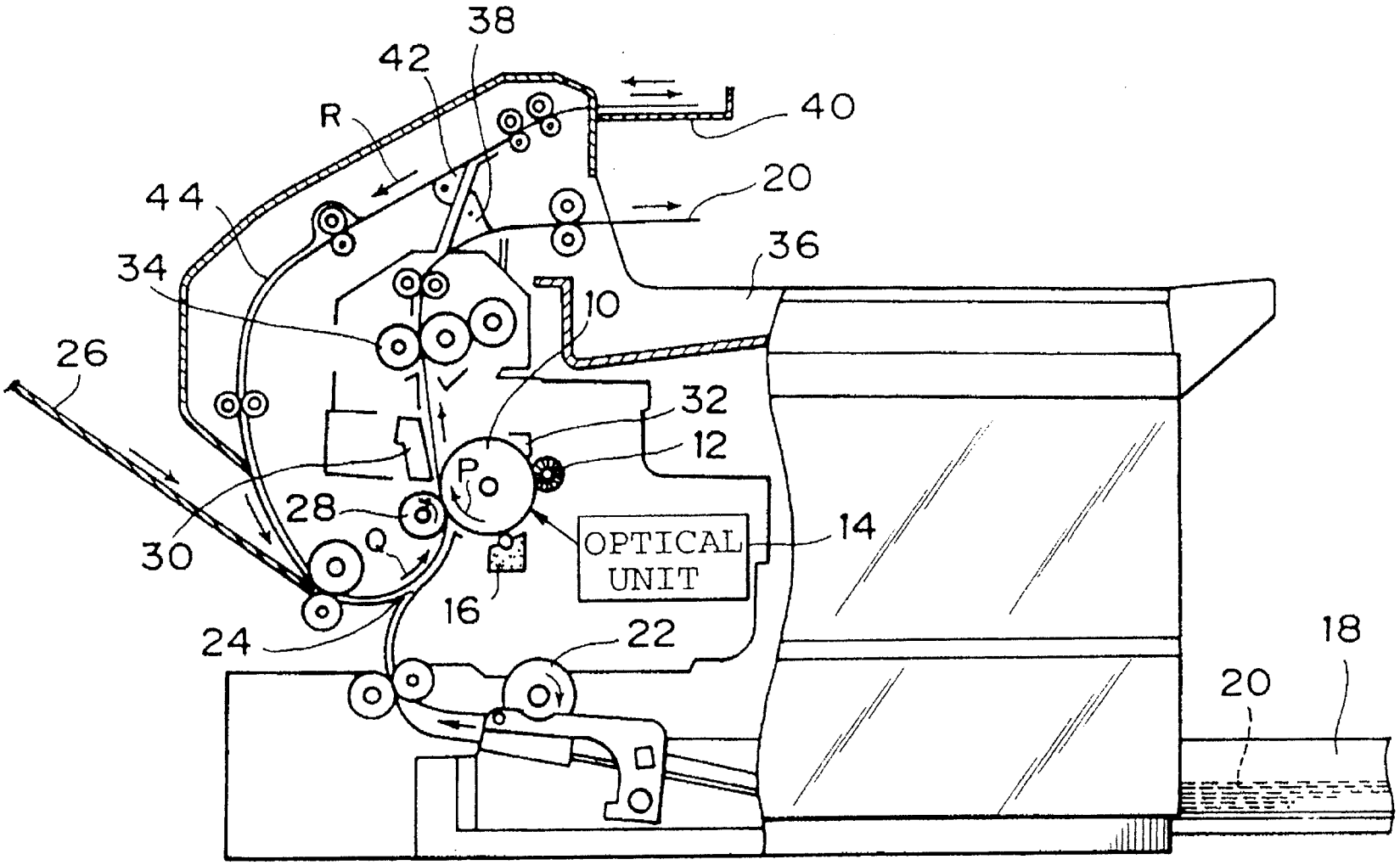
FIG. 1 is a schematic side view of a printer to which the present invention is suitably applied.

Referring to FIG. 1, there is shown a partially cutaway, schematic side view of an electrophotographic printer such as a laser beam printer to which a conductive brush charging device according to the present invention is suitably applied. Reference numeral 10 denotes a photosensitive drum to be rotated at a constant speed in a direction shown by an arrow P. The photosensitive drum 10 is charged to a given potential by a conductive brush charger 12, and is next exposed to light according to image information by an optical unit 14 to form an electrostatic latent image on the cylindrical surface of the photosensitive drum 10. The electrostatic latent image is developed by a developing unit 16 to form a toner image on the photosensitive drum 10.

On the other hand, a sheet of paper 20 supplied from a cassette 18 by rotation of a feed roller 22 or a sheet of paper inserted from a manual feed guide 26 is fed through a paper feed path 24 in a direction shown by an arrow Q. The toner image formed on the photosensitive drum 10 is next transferred to the front surface of the paper 20 by charge applied to the back surface of the paper 20 by a transfer roller 28. The toner image transferred onto the paper 20 is next fixed to the paper 20 under pressure by a fuser 34, and the paper 20 is next ejected to a stacker 36 in the case of single-sided printing. It is difficult to fully transfer the toner image on the photosensitive drum 10 to the paper 20, so that some of the toner remains on the photosensitive drum 10. This residual toner is cleaned from the photosensitive drum 10 by a cleaner 32, thus preparing for the next cycle of print operation.

In the case of double-sided printing, when an operation panel (not shown) of the printer is operated to instruct the printer to carry out double-sided printing, the single-sided printing mode is changed to a double-sided printing mode by a control section of the printer. In this case, a gate 38 provided in the paper feed path 24 is switched to feed the paper 20 whose front surface has been printed to a paper reversing unit 40. After the paper 20 is stored into the paper reversing unit 40, a gate 42 is switched to feed the paper 20 through a paper feed path 44 in a direction shown by an arrow R. Thereafter, a toner image is transferred and fixed to the back surface of the paper 20, and is finally ejected to the stacker 36.

Figure 2:
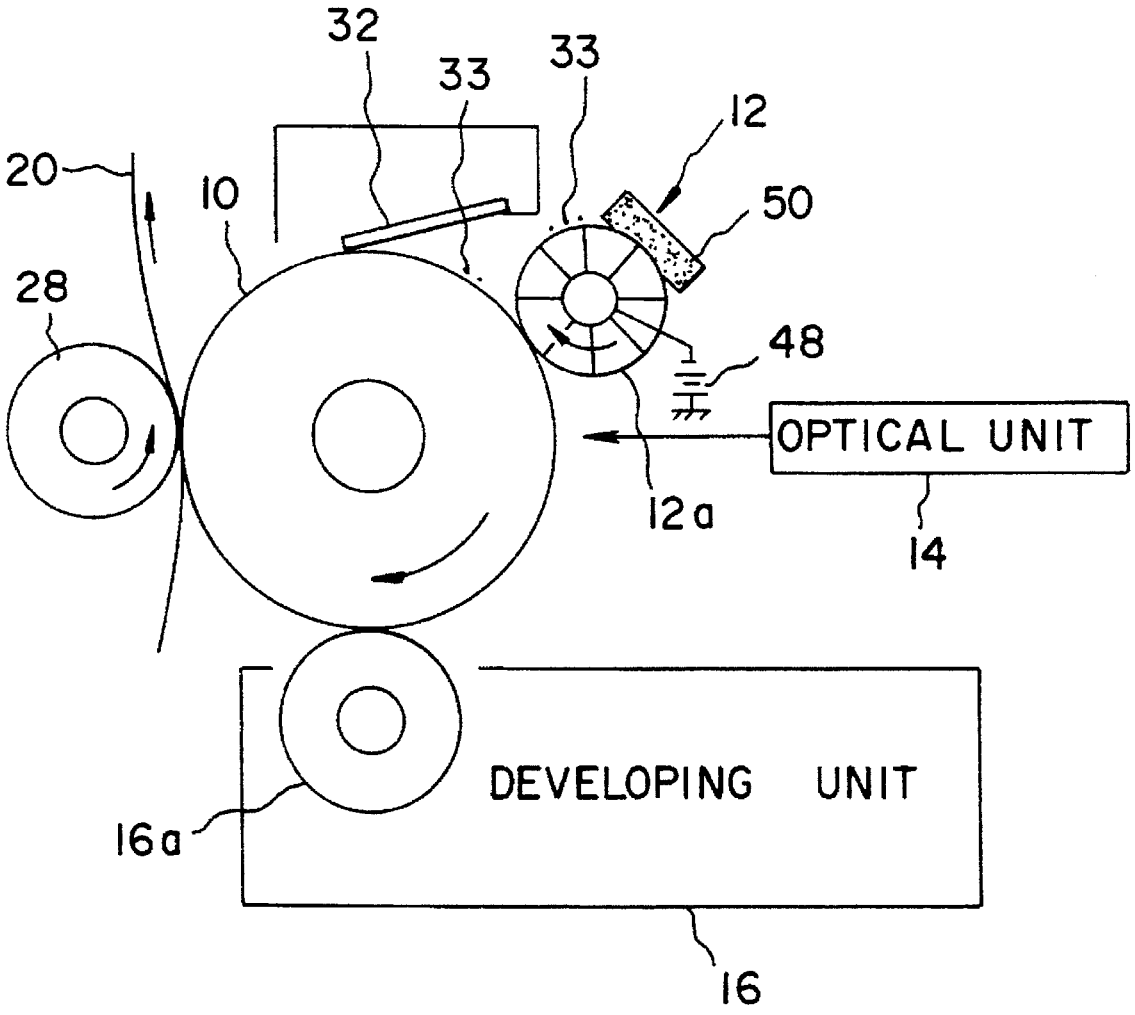
FIG. 2 is a side view of a first preferred embodiment of the present invention.

The conductive brush charger 12 according to a first preferred embodiment of the present invention will now be described in detail with reference to FIG. 2. A conductive brush 12*a* of the brush charger 12 is biased to a given potential by a bias power supply 48. Accordingly, the photosensitive drum 10 is charged to a given potential by sliding contact between the photosensitive drum 10 and the conductive brush 12*a*. The photosensitive drum 10 is next exposed to light according to image information by the optical unit 14, thus forming an electrostatic latent image on the photosensitive drum 10.

This electrostatic latent image is developed to a toner image by a developing roller 16*a* of the developing unit 16, and the toner image is next transferred to the paper 20 by the transfer roller 28 to which a voltage with polarity opposite to the polarity of the toner image has been applied. A residual toner left on the photosensitive drum 10 after the transfer process is cleaned from the photosensitive drum 10 by the cleaner 32; however, the residual toner is not completely cleaned off in some cases, and a small amount of toner 33 yet remains on the photosensitive drum 10 even after the cleaning process.

The photosensitive drum 10 on which the residual toner 33 remains comes into sliding contact with the conductive brush 12*a* of the brush charger 12, so that the residual toner 33 sticks to the conductive brush 12*a*. According to this preferred embodiment, the brush charger 12 includes a toner removing plate 50 formed of a porous material, e.g., an ether urethane foam, having an electric insulating property. The toner removing plate 50 is pressed against the conductive brush 12*a* in a surface-contact fashion, thereby removing the toner deposited to the conductive brush 12*a*.

Figure 3:
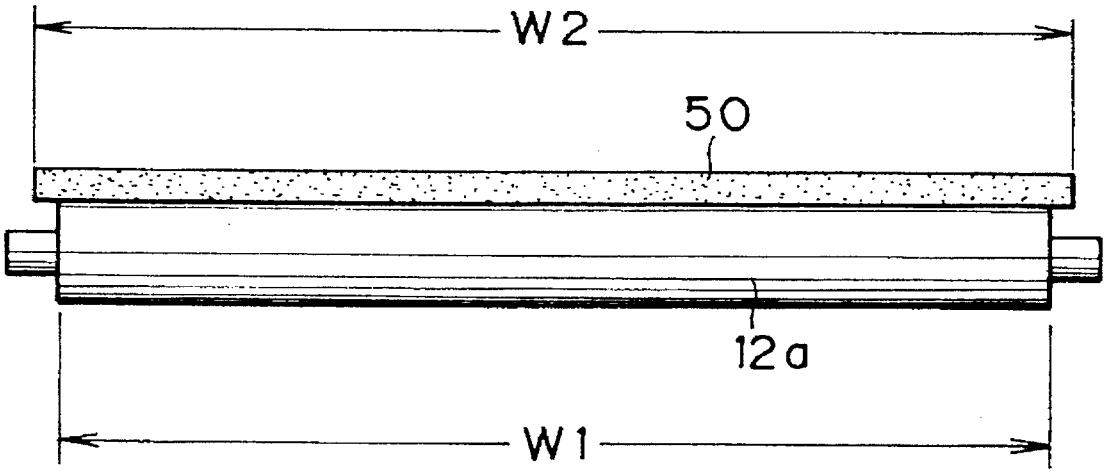
FIG. 3 is an elevational view of the first preferred embodiment.

The toner removing plate 50 formed of a urethane foam has high heat resistance and is hardly hydrolyzed. As shown in FIG. 3, the toner removing plate 50 extends over the width (axial length) of the conductive brush 12*a*. More specifically, letting W1 and W2 denote the width of the conductive brush 12*a* and the width of the toner removing plate 50, respectively, the relation of $W1 \leqq W2$ is set.

Since the toner removing plate 50 is formed of a soft foam, the surface contact of the toner removing plate 50 and the conductive brush 12*a* can be effected with a small load on the conductive brush 12*a*. In other words, the depth of penetration of the toner removing plate 50 into the conductive brush 12*a* can be increased. As a result, the generation of frictional heat due to sliding contact between the conductive brush 12*a* and the toner removing plate 50 can be reduced, and the plastic deformation of the conductive brush 12*a* can be prevented. Further, the toner removing plate 50 can be easily replaced after it is worn.

The porous foam forming the toner removing plate 50 in this preferred embodiment has the following characteristic values, i.e., a density of 10 to 90 kg/m3, preferably, 18 to 22 kg/m3, a restitution elasticity of 30% or less, a hardness of 2 to 170 kg, preferably, 5 to 11 kg, the number of cells of 10 to 90 cells/25 mm, preferably, 10 to 30 cells/25 mm, a tensile strength of 0.5 kg/m2 or less, an elongation of 100% or less, a compressive residual strain of 0.4% or more, and a repeated compressive residual strain of 5% or more.

With the configuration of the brush charger 12 according to this preferred embodiment mentioned above, the toner 33 scraped from the conductive brush 12*a* by the toner removing plate 50 due to the sliding contact between the toner removing plate 50 and the conductive brush 12*a* is electrostatically deposited to the toner removing plate 50 charged by friction, so that the toner 33 is securely retained on and inside the porous foam.

Accordingly, while the conductive brush 12*a* is being rotated, that is, while the print operation is being carried out, the residual toner can be always removed from the conductive brush 12*a*, and a given potential can therefore be applied from the conductive brush 12*a* to the photosensitive drum 10. As a result, the charging characteristics of the brush charger 12 to the photosensitive drum 10 can be stabilized over a long period of time, and the occurrence of fog in the background area of a printed sheet can be suppressed to thereby ensure a good print quality.

Figure 4:
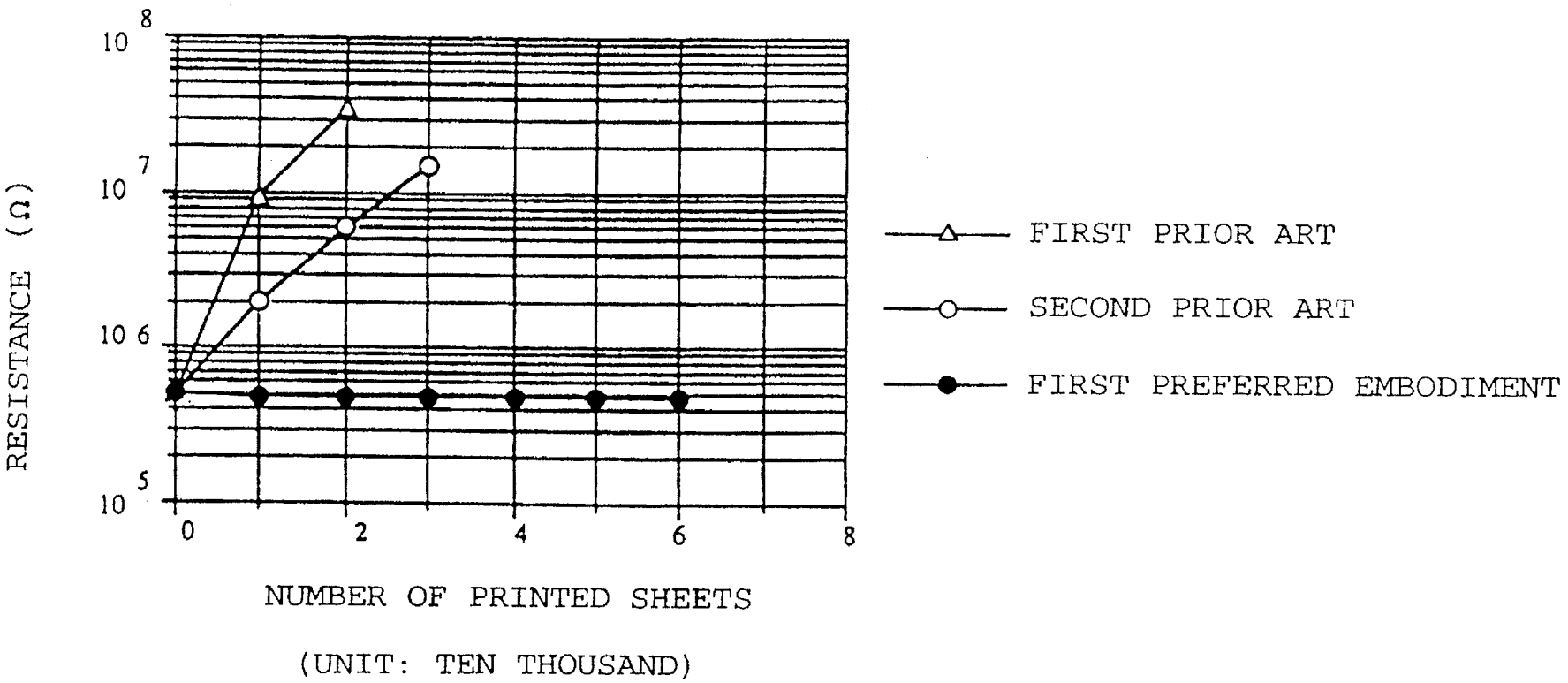
FIG. 4 is a graph showing the resistance of a conductive brush in the first preferred embodiment in comparison with the prior art.
Figure 5:
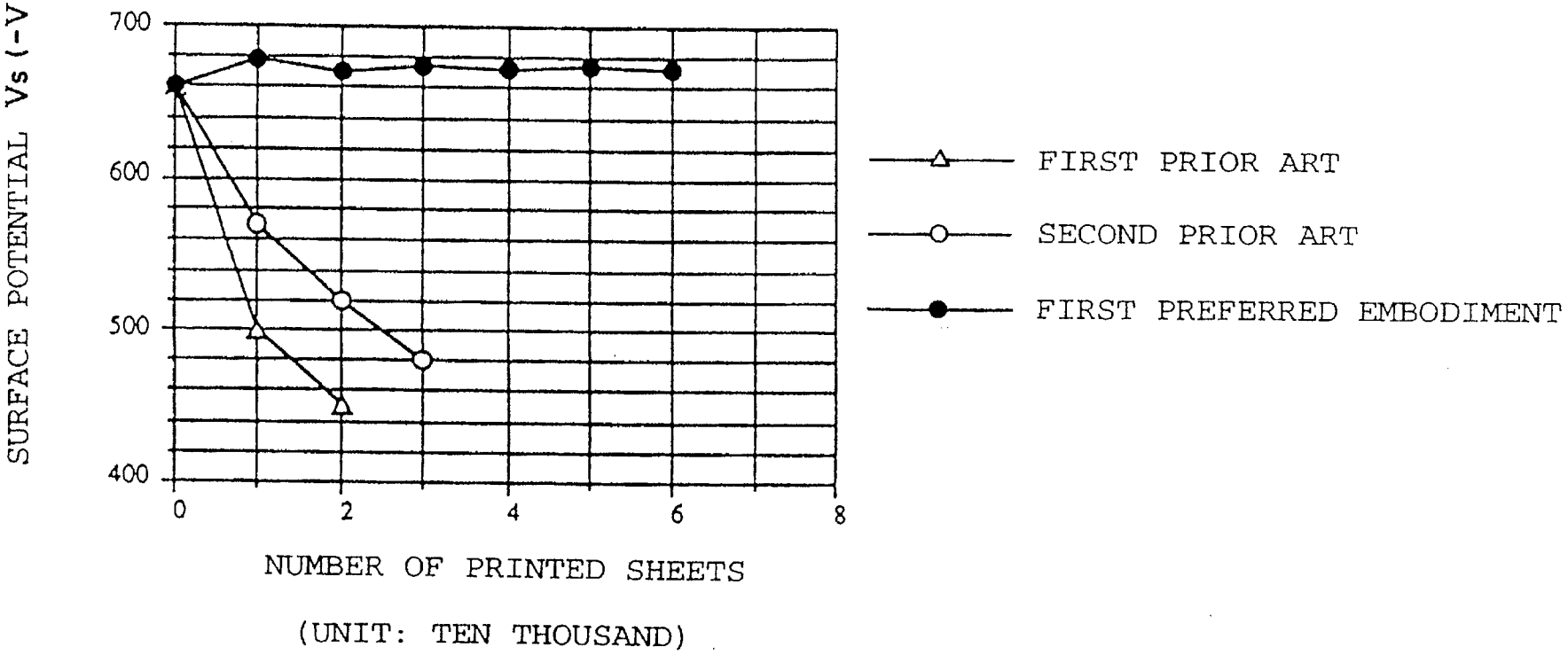
FIG. 5 is a graph showing the surface potential of a photosensitive drum in the first preferred embodiment in comparison with the prior art.
Figure 6:
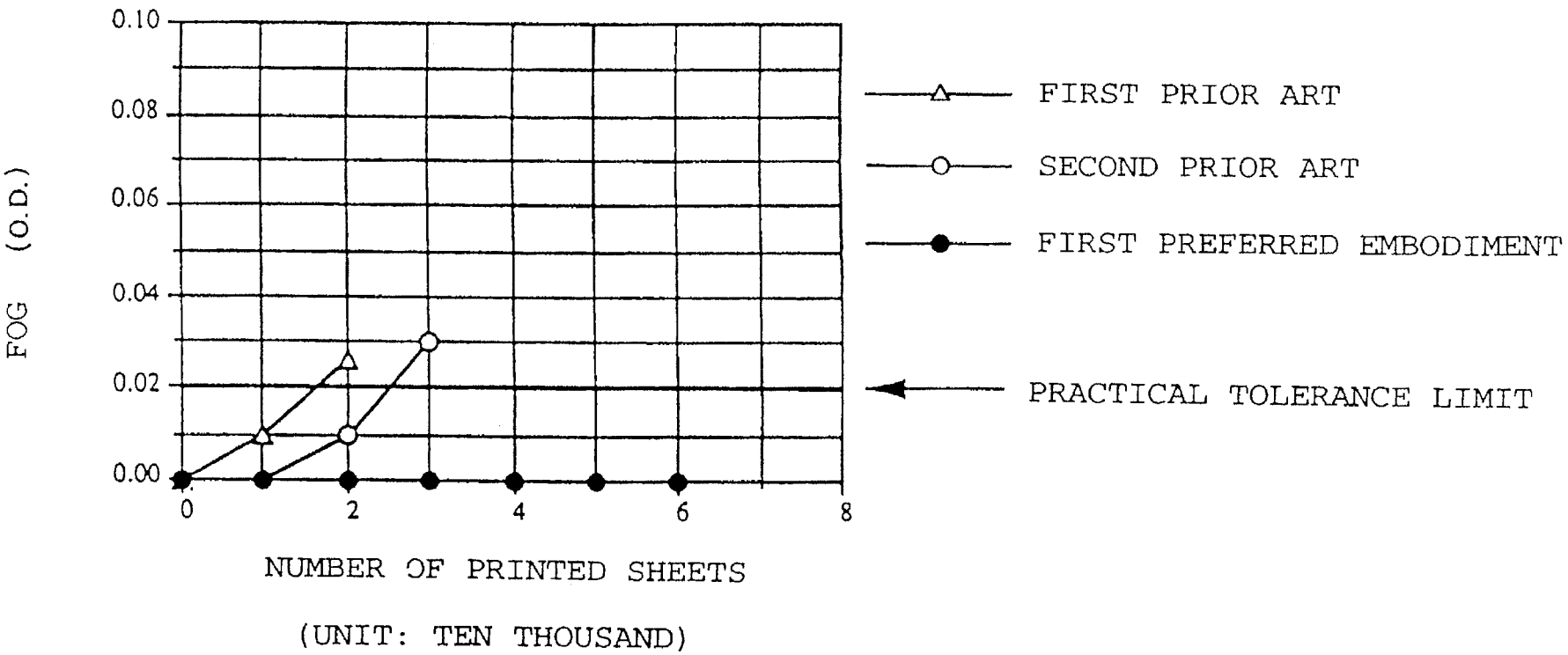
FIG. 6 is a graph showing the fog on the photosensitive drum in the first preferred embodiment in comparison with the prior art.

The effect of the first preferred embodiment mentioned above will now be described with reference to FIGS. 4 to 6 in comparison with the prior art previously described with reference to FIGS. 9 and 10. FIGS. 4 to 6 show the results of measurement obtained by continuously printing many A4-sized sheets of paper with the paper feed direction coinciding with the longitudinal direction of each sheet. More specifically, FIG. 4 shows the resistance (Ω) of the conductive brush due to the toner deposited thereto, which resistance increases with an increase in the cumulative number of printed sheets; FIG. 5 shows the surface potential (Vs) of the photosensitive drum decreasing with an increase in the resistance of the conductive brush; and FIG. 6 shows the amount of fog (optical density) increasing with a decrease in the surface potential of the photosensitive drum.

Figure 9:
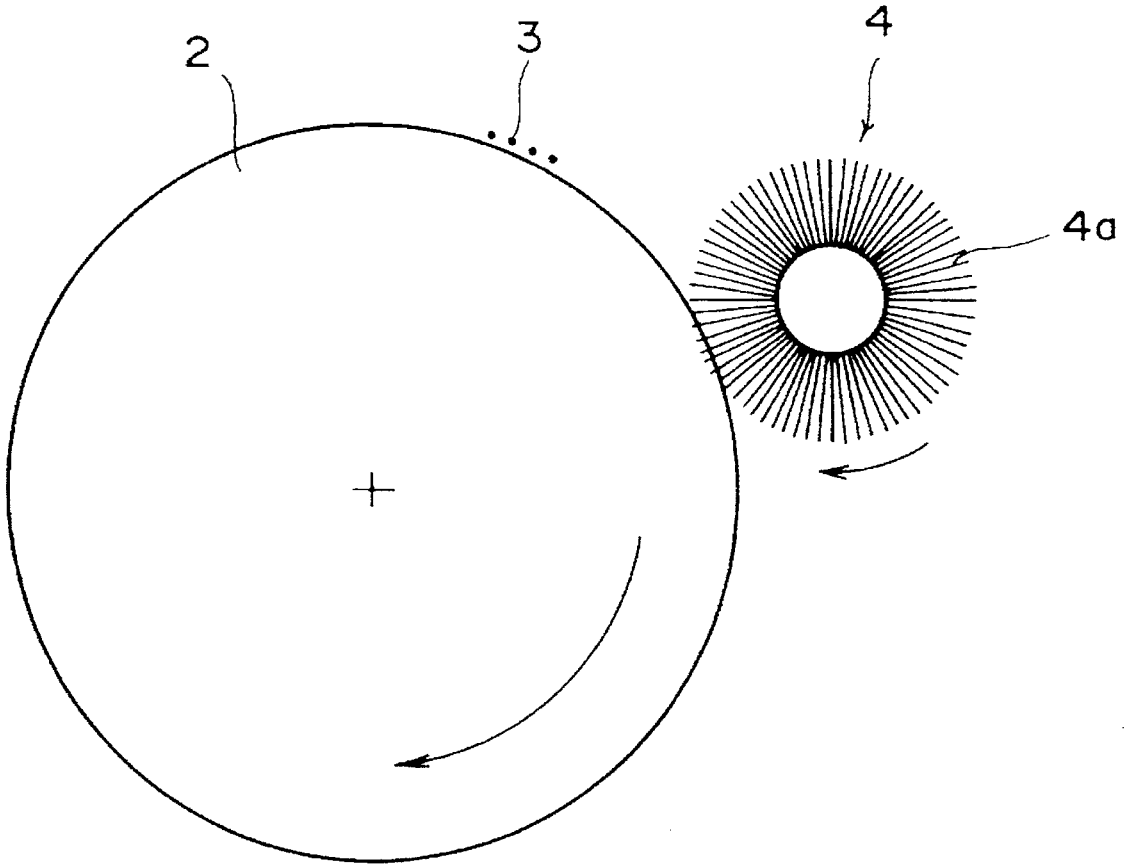
FIG. 9 PRIOR ART
FIG. 9 is a side view of a first example in the prior art.
Figure 10:
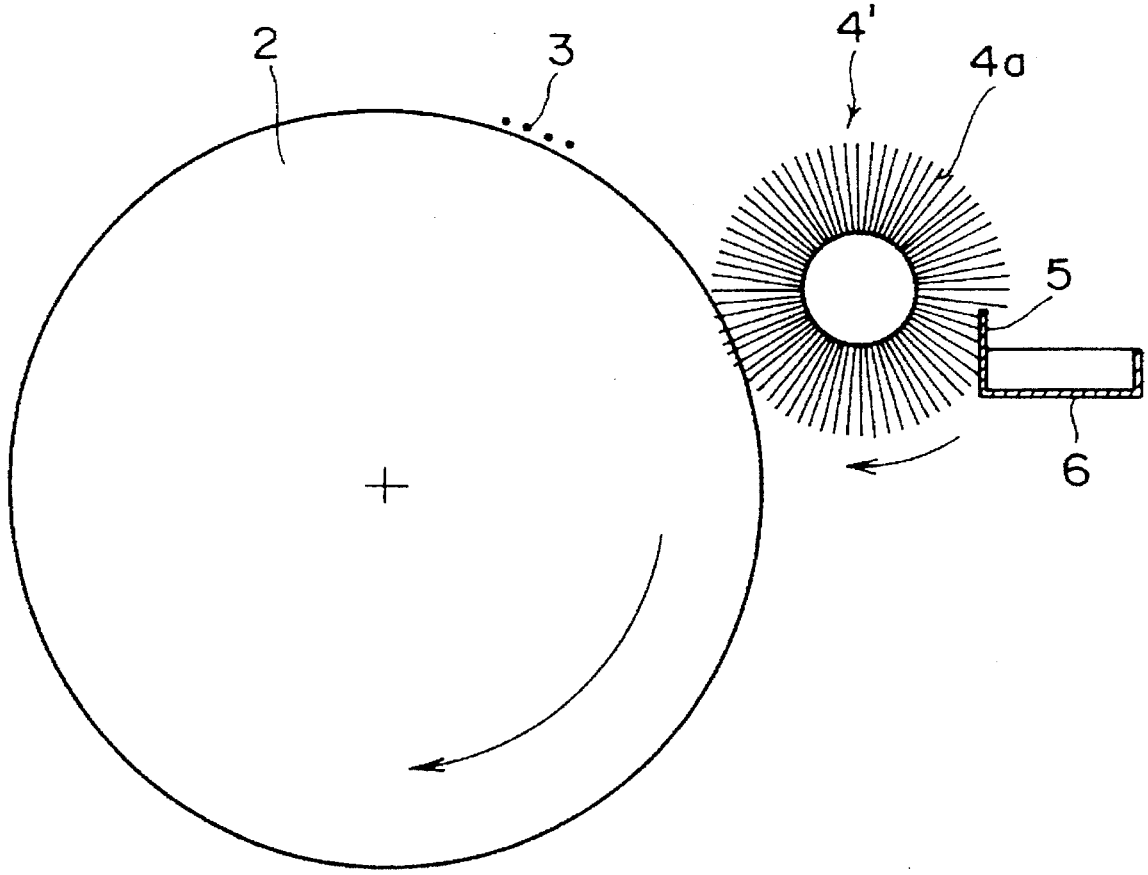
FIG. 10 PRIOR ART
FIG. 10 is a side view of a second example in the prior art.

As apparent from FIG. 6, the cumulative numbers of printed sheets corresponding to the practical tolerance limit of the optical density in the first example of the prior art shown in FIG. 9 and in the second example of the prior art shown in FIG. 10 are eighteen thousands and twenty-five thousands, respectively. To the contrary, the cumulative number of printed sheets in the first preferred embodiment is sixty thousands or more. Accordingly, a good print quality can be ensured over a long period of time according to the first preferred embodiment.

Figure 7:
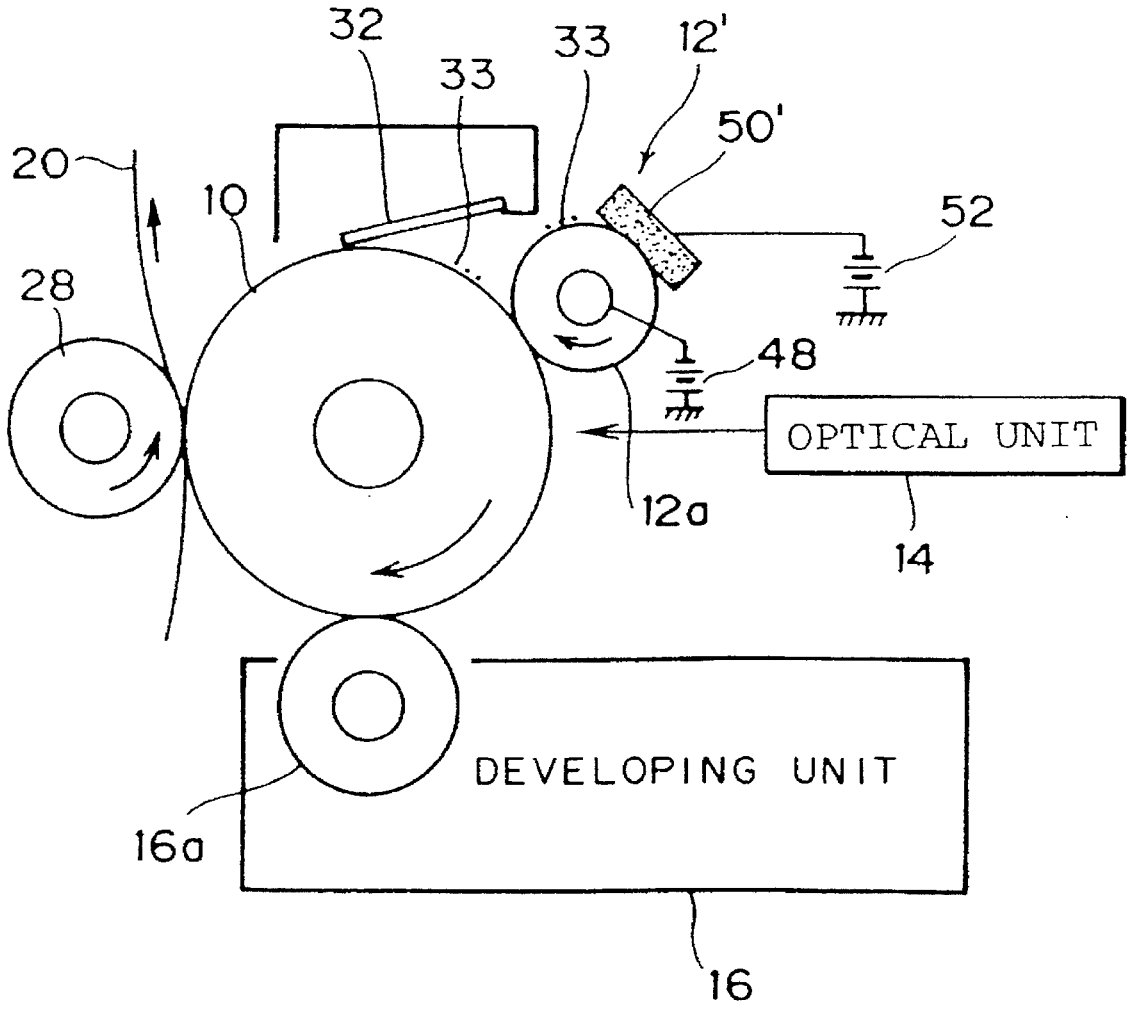
FIG. 7 is a side view of a second preferred embodiment of the present invention.

Referring to FIG. 7, there is shown a schematic side view of a second preferred embodiment of the present invention. In the following description of this preferred embodiment, substantially the same parts as those in the first preferred embodiment will be denoted by the same reference numerals, and the description thereof will be omitted to avoid repetition. In contrast to the first preferred embodiment employing the toner removing plate 50 formed of a urethane foam having an electric insulating property, the second preferred embodiment employs a toner removing plate 50' formed of a urethane foam impregnated with a conductive substance, and a bias power supply 52 for applying to the toner removing plate 50' a voltage higher than the voltage applied from a bias power supply 48 to a conductive brush 12*a*.

For example, a voltage of −650 V is applied from the bias power supply 48 to the conductive brush 12*a*, and a voltage of −800 V is applied from the bias power supply 52 to the toner removing plate 50'. According to this preferred embodiment, a bias voltage higher than that applied to the conductive brush 12*a* is applied to the toner removing plate 50', so that the toner can be electrically removed from the conductive brush 12*a* in addition to the function of removal of the toner by sliding contact between the conductive brush 12*a* and the toner removing plate 50'.

According to this preferred embodiment, since the toner attraction force of the toner removing plate 50' is larger than that in the first preferred embodiment, it is unnecessary to so strongly press the toner removing plate 50' against the conductive brush 12*a*. As a result, the load applied to the conductive brush 12*a* in the second preferred embodiment can be set lower than that in the first preferred embodiment, thereby further suppressing the occurrence of frictional heat and further extending the service life of the conductive brush 12*a*.

Figure 8:
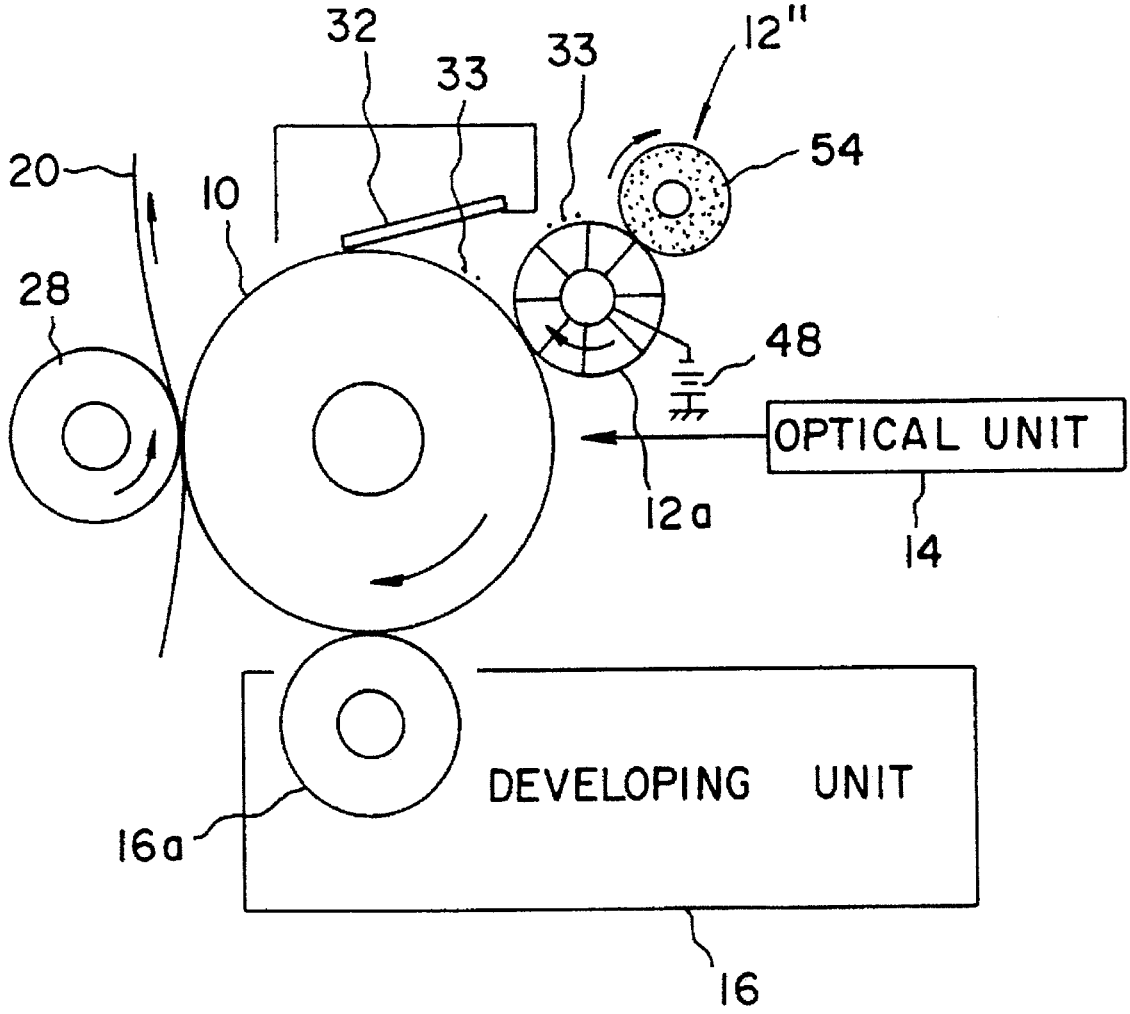
FIG. 8 is a side view of a third preferred embodiment of the present invention.

Referring to FIG. 8, there is shown a schematic side view of a third preferred embodiment of the present invention. In the following description of the third preferred embodiment, substantially the same parts as those in the first and second preferred embodiments will be denoted by the same reference numerals, and the description thereof will be omitted to avoid repetition. This preferred embodiment employs a toner removing roller 54 formed of a urethane foam, for example, instead of the toner removing plate 50 in the first preferred embodiment. The toner removing roller 54 is rotated in contact with a conductive brush 12*a* to thereby remove the toner deposited to the conductive brush 12*a*.

The toner removing roller 54 may be rotationally driven as slipping by rotation of the conductive brush 12*a* under a certain degree of load. However, preferably, the toner removing roller 54 is rotationally driven by an independent drive source at a peripheral speed different from the peripheral speed of the conductive brush 12*a*. More preferably, the toner removing roller 54 is rotated in a direction opposite to the direction of rotation of the conductive brush 12*a* or the toner removing roller 54 is counter-rotated with respect to the rotation of the conductive brush 12*a*, because the larger the peripheral speed ratio between the roller 54 and the brush 12*a*, the greater the cleaning effect.

Since the contact surface between the toner removing roller 54 and the conductive brush 12*a* is not fixed, but always varies by the rotation of the roller 54, the contactable area of the toner removing roller 54 to the conductive brush 12*a* can be increased. Furthermore, by increasing the diameter of the toner removing roller 54, the toner retaining capacity of the toner removing roller 54 can be increased to thereby allow more residual toner to be caught by the roller 54.

In the case that the toner removing roller 54 is rotated at a peripheral speed different from the peripheral speed of the conductive brush 12*a*, or in the case that the roller 54 and the brush 12*a* are rotated in opposite directions, the depth of contact between the conductive brush 12*a* and the toner removing roller 54 can be reduced with an enough cleaning performance being maintained, thereby reducing the load on the conductive brush 12*a*. Accordingly, the service life of the conductive brush 12*a* can be more extended with a good efficiency of toner removal being maintained. As a modification, the toner removing roller 54 may be made conductive like the second preferred embodiment, and a given bias voltage may be applied to the conductive toner removing roller 54 in this case.

According to the present invention, the developer removing member formed of a porous material is kept in surface contact with the conductive brush. Accordingly, the developer deposited to the conductive brush can be efficiently removed to thereby maintain the charging characteristics of the conductive brush to the image forming member at a satisfactory level over a long period of time. As a result, the occurrence of fog in the background area of a printed sheet can be prevented to improve a print quality. Further, the developer scraped from the conductive brush is retained in the pores of the porous developer removing member. Accordingly, it is unnecessary to provide a receptacle for receiving the toner scraped from the conductive brush, thereby achieving simplification and cost reduction of the charging device.

What is claimed is:

1. A conductive brush charging device for charging a surface of an image forming member, comprising:

a conductive brush located so as to rotate in contact with said image forming member;

a voltage applying means for applying a given voltage to said conductive brush; and a developer removing member formed of a porous material and located so as to be kept in surface contact with said conductive brush over an entire width thereof.

2. A conductive brush charging device according to claim 1, wherein said developer removing member comprises a plate member formed of a foamed material.

3. A conductive brush charging device according to claim 1, wherein said developer removing member is formed of a conductive material, and said conductive brush charging device further comprises a means for applying to said conductive developer removing member a voltage higher than said given voltage applied to said conductive brush.

4. A conductive brush charging device according to claim 1, wherein said developer removing member comprises a roller rotatably supported.

5. A conductive brush charging device according to claim 4, wherein said roller is formed of a conductive material, and said conductive brush charging device further comprises a means for applying to said conductive roller a voltage higher than said given voltage applied to said conductive brush.

6. A conductive brush charging device according to claim 4, wherein said roller is rotated at a peripheral speed different from a peripheral speed of said conductive brush.

7. A conductive brush charging device according to claim 6, wherein said roller is rotated in a direction opposite to a rotational direction of said conductive brush.

* * * * *